US008491683B1

(12) United States Patent
Brown-Fitzpatrick et al.

(10) Patent No.: US 8,491,683 B1
(45) Date of Patent: Jul. 23, 2013

(54) COMPUTER SYSTEM INCLUDING ELECTRODES FOR AUTOMATED DUST FILTER CLEANING

(71) Applicants: Kathy L. Brown-Fitzpatrick, Research Triangle Park, NC (US); Gary D. Cudak, Creedmoor, NC (US); Christopher J. Hardee, Raleigh, NC (US); James R. Lee, Raleigh, NC (US); John Lloyd, Durham, NC (US); William E. Lohmeyer, Jr., Apex, NC (US); Andrew H. Wray, Hillsborough, NC (US)

(72) Inventors: Kathy L. Brown-Fitzpatrick, Research Triangle Park, NC (US); Gary D. Cudak, Creedmoor, NC (US); Christopher J. Hardee, Raleigh, NC (US); James R. Lee, Raleigh, NC (US); John Lloyd, Durham, NC (US); William E. Lohmeyer, Jr., Apex, NC (US); Andrew H. Wray, Hillsborough, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 13/648,299

(22) Filed: Oct. 10, 2012

(51) Int. Cl.
*B03C 3/68* (2006.01)

(52) U.S. Cl.
USPC ..... 55/283; 55/301; 55/385.6; 96/19; 96/30; 96/31; 96/54; 96/63

(58) Field of Classification Search
USPC ..... 96/19, 30, 31, 54, 63, 66, 75, 80; 55/283, 55/301, 385.6; 95/3, 4, 74, 78–80; 700/273, 700/297, 298
See application file for complete search history.

(56) References Cited

U.S. PATENT DOCUMENTS

| | | | | |
|---|---|---|---|---|
| 3,475,882 | A * | 11/1969 | Hoenig | 96/30 |
| 4,772,297 | A * | 9/1988 | Anzai | 96/19 |
| 5,855,762 | A * | 1/1999 | Phillips et al. | 205/634 |
| 6,660,061 | B2 * | 12/2003 | Josephson et al. | 95/2 |
| 7,001,447 | B1 | 2/2006 | Altman et al. | |
| 7,294,169 | B2 * | 11/2007 | Taylor | 95/2 |
| 7,708,813 | B2 * | 5/2010 | Wiser et al. | 96/17 |
| 7,833,310 | B2 * | 11/2010 | Kwon et al. | 95/3 |
| 7,862,649 | B2 * | 1/2011 | Sakuma et al. | 96/19 |
| 7,875,099 | B2 * | 1/2011 | Abraham et al. | 95/4 |

(Continued)

FOREIGN PATENT DOCUMENTS

| | | | |
|---|---|---|---|
| CA | 2752633 | A1 | 11/2011 |
| JP | 59-145015 | A * | 8/1984 |
| JP | 2005-16739 | A | 1/2005 |
| WO | WO2010114742 | A2 | 10/2010 |

OTHER PUBLICATIONS

RD461166 "Disk Storage Device with Intra-Disk Air Cleaning" Research Disclosure, Sep. 2002, 2 pages.

(Continued)

*Primary Examiner* — Richard L Chiesa
(74) *Attorney, Agent, or Firm* — Cynthia G. Seal; Jeffrey L. Streets

(57) ABSTRACT

A computer system includes a computer chassis housing a processor and having a dust filter disposed in an airflow pathway through the computer chassis. A plurality of electrodes is disposed across an area of the dust filter, and a voltage source is provided having a negative terminal and a positive terminal. A controller selectively couples a first subset of electrodes to the negative terminal and selectively couples a second subset of electrodes to the positive terminal, wherein a voltage differential between the first subset of electrodes and the second subset of electrodes is sufficient to cause electrostatic movement of dust from an area of the dust filter near the first subset of electrodes to an area of the dust filter near the second subset of electrodes.

7 Claims, 5 Drawing Sheets

U.S. PATENT DOCUMENTS

| | | | | |
|---|---|---|---|---|
| 2009/0056551 | A1 | 3/2009 | Furuta et al. | |
| 2009/0071329 | A1 | 3/2009 | Oldani | |
| 2009/0301299 | A1 | 12/2009 | Carlson | |
| 2010/0031823 | A1 | 2/2010 | Cowie et al. | |
| 2010/0229724 | A1* | 9/2010 | Tokuda et al. | 96/19 |
| 2011/0168463 | A1* | 7/2011 | Perkins et al. | 180/65.21 |

OTHER PUBLICATIONS

Haupt, "Electrostatic Precipitator Filter", Xerox Disclosure Journal—vol. 15, No. 3 (May/Jun. 1990), IP.com Prior Art Database, Jun. 30, 1990, 3 pages.

* cited by examiner

COMPUTER SYSTEM INCLUDING ELECTRODES FOR AUTOMATED DUST FILTER CLEANING

BACKGROUND OF THE INVENTION

1. Field of the Invention

The present invention relates to a dust filter and an apparatus for automated dust filter cleaning.

2. Background of the Related Art

Airflow is commonly used to remove heat generated by components within a computer. For example, an individual PC typically includes one or more on-board cooling fans disposed within the housing to cool the processors, power supply, memory, and other internal components. In more expansive computer systems, such as rack-based computer systems having multiple servers, one or more blower modules are supported on a chassis along with the servers to generate airflow through the servers and other components. Despite efforts to keep a computer center clean and filter dust out of the air, the airflow used to cool a computer carries some amount of dust, which accumulates over time on internal components of the computer.

Unfortunately, dust accumulation can cause problems in a computer system. Excessive dust build-up can reduce performance, increase the rate at which components fail, and reduce overall system reliability. Dust can interfere with operation of moving parts, such as fan blades and mechanical connectors, and reduce the reliability of electrical components, such as by dirtying electrical contacts in electrical connectors. Dust can even give off an unpleasant odor in the presence of hot components.

Dust can be especially problematic for heatsinks. A heatsink typically protrudes beyond neighboring components, positioning the heatsink well into the airflow for cooling. Thus, dust may accumulate more heavily on a heatsink than on other components. Dust deposited on heatsink fins can reduce the thermal efficiency of the heatsink, which affects the temperature and cooling performance of the hardware device in contact with the heatsink. These effects are compounded in rack systems having many servers that each contains one or more processors and dust-accumulating heatsinks. Furthermore, the need to remove and inspect each server and other hardware devices for accumulated dust causes an increase in the time and associated expense involved with system maintenance.

Some computer chassis now have removable dust filters that extract dust particles from the air before the air enters the computer chassis. Over time these filters become clogged with dust blocking the airflow through the chassis and reducing the capacity to cool heat-generating components within the chassis. Current solutions include replacing the filter or advancing a filter roll.

BRIEF SUMMARY OF THE INVENTION

An embodiment of the present invention provides a computer system comprising a computer chassis housing a processor and having an airflow pathway through the computer chassis. A dust filter is disposed in the airflow pathway, a plurality of electrodes is disposed across an area of the dust filter, and a voltage source is provided having a negative terminal and a positive terminal. The computer system further comprises a controller for selectively coupling a first subset of the plurality of electrodes to the negative terminal and selectively coupling a second subset of the plurality of electrodes to the positive terminal, wherein a voltage differential between the first subset of electrodes and the second subset of electrodes is sufficient to cause electrostatic movement of dust from an area of the dust filter near the first subset of electrodes to an area of the dust filter near the second subset of electrodes.

DETAILED DESCRIPTION OF THE INVENTION

Figure 1:
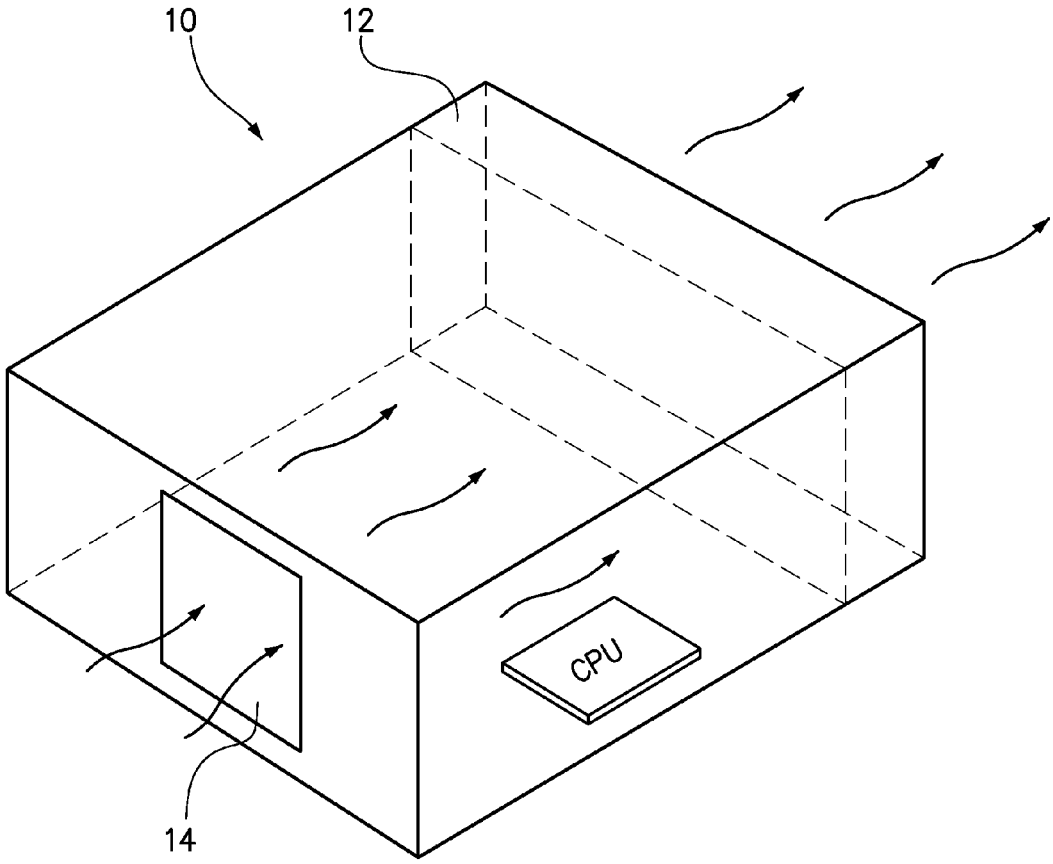
FIG. 1 is a perspective view of a computer chassis that supports forced air cooling.

One embodiment of the present invention provides a method of cleaning a dust filter. The method comprises applying a negative electrical potential to a first electrode disposed in a first area of a dust filter and applying a positive electrical potential to a second electrode disposed in a second area of the dust filter, wherein a voltage differential between the first electrode and the second electrode is sufficient to cause electrostatic movement of dust from the first area of the dust filter to the second area of the dust filter. The method then further comprises applying a negative electrical potential to the second electrode and applying a positive electrical potential to a third electrode disposed in a third area of the dust filter, wherein a voltage differential between the second electrode and the third electrode is sufficient to cause electrostatic movement of dust from the second area of the dust filter to the third area of the dust filter, and wherein the first, second and third areas are generally linearly arranged with the second area between the first and third areas.

The dust filter may be made from any porous material that is electrically nonconductive. Typically, the filter is a unitary piece of a fibrous material or open-cell polymer foam material. The pores are preferably small enough to catch typical dust particles, but large enough to allow unimpeded air flow through the filter.

The electrodes are disposed at spaced apart positions across a downstream face of the dust filter. In a typical computer chassis, the airflow is from a front of the chassis to a rear of the chassis, with the dust filter in the front extending across an air inlet. Where the computer chassis has its own fan module, the fan module is typically in the rear of the chassis to pull air from a cold aisle through the dust filter, through the chassis and out the rear of the chassis to a hot aisle. Accordingly, the electrodes are preferably disposed within the computer chassis, directly adjacent or in contact with the inside face of the dust filter. The number of electrodes, their configuration and arrangement, and their spacing may vary to clean a particular filter having a given amount of surface area to be cleaned using a given voltage differential. In one embodiment, the electrodes form an array that includes a plurality of rows and a plurality of columns. The placement of an electrode establishes an area of the dust filter around the electrode where the electrode can influence dust movement.

Although the present invention can be effective by applying a negative electrical potential to a single electrode and applying a positive electrical potential to an adjacent single electrode at any one time, a larger area of a dust filter may be simultaneously cleaned by using sets of multiple electrodes. For example, the method may apply a negative electrical potential to a first row of electrodes disposed across an upper area of the dust filter and apply a positive electrical potential to a second row of electrodes disposed across an adjacent (lower) area of the dust filter. Conveniently, each of the electrodes being operated in a set may be operated at the same electrical potential and at the same time.

By controlling the application of electrical potential to the electrodes, the dust that has accumulated on a dust filter may be moved in a desired direction, such as right to left, left to right, top to bottom, diagonally, and the like. Depending upon the extent of independent control and switching that is available, the electrode may move dust in one of multiple directions in response to prevailing conditions such as an airflow direction. Furthermore, an electrode may be included in a first set of electrodes during one step of a cleaning operation, and may be later included in a different set of electrodes. Most preferably, the arrangement of the electrodes and the electrical potential being applied to the electrode are used to "roll" the dust across the filter to one side, rather than blasting the dust out into the air in the "hot aisle" where the dust will eventually settle onto the dust filter again.

In an alternative embodiment, the dust filter may be made of an electrically conductive material, wherein the dust filter includes multiple filter section that are electrically isolated from each other. Periodically, a current is applied to each of the sections, for example starting with a top section and progressing down to a bottom section. The dust filter may be divided into any number of sections and programmatically activated to cause sequential dust removal in a desired direction.

In one embodiment, the method causes electrostatic movement of dust from the dust filter into a duct. A preferred duct includes an inlet that is directly adjacent the dust filter. In one option, a damper to the inlet of the duct may be automatically opened, such as by activating a motor, to allow the dust and airflow to pass through the duct.

A further embodiment of the method comprises applying a negative electrical potential to the third electrode (aligned with the dust filter) and applying a positive electrical potential to a fourth electrode disposed in an inlet of a duct, wherein the inlet of the duct is directly adjacent the third area of the dust filter, and wherein a voltage differential between the third electrode and the fourth electrode is sufficient to cause electrostatic movement of dust from the third area of the dust filter into the duct. Accordingly, the damper to the inlet of the duct may be automatically caused to be open while the fourth electrode has a positive electrical potential. It is preferred to have air flowing through the duct while the damper is open, wherein the air flowing through the duct moves dust from the inlet of the duct to an outlet of the duct. Such airflow may be induced using a fan that is dedicated to the duct, or by arranging the duct so that a chassis fan will draw air through the duct whenever the damper is open. However, the fan speed of a chassis fan, which is used to cause airflow through the dust filter, may be reduced to facilitate the electrostatic movement of the dust from the dust filter.

The steps of the foregoing methods may be periodically repeated to clean the dust filter. For example, the method may be performed at fixed time intervals. Alternatively, the method may be performed in response to one or more conditions, such as a pressure drop across the dust filter, a change in electrical conductivity of the dust filter, or a rise in one or more temperature within the computer chassis.

Another embodiment of the present invention provides a computer system comprising a computer chassis housing a processor and having an airflow pathway through the computer chassis. A dust filter is disposed in the airflow pathway, a plurality of electrodes is disposed across an area of the dust filter, and a voltage source is provided having a negative terminal and a positive terminal. The computer system further comprises a controller for selectively coupling a first subset of the plurality of electrodes to the negative terminal and selectively coupling a second subset of the plurality of electrodes to the positive terminal, wherein a voltage differential between the first subset of electrodes and the second subset of electrodes is sufficient to cause electrostatic movement of dust from an area of the dust filter near the first subset of electrodes to an area of the dust filter near the second subset of electrodes.

The controller may be a controller that is dedicated to the control of the electrodes and their sequencing, or the controller may be a multi-purpose controller. Although the controller may be an analog device, the controller is preferably a processor, such as a central processing unit (CPU), a fan controller, an application specific integrated circuit (ASIC), a baseboard management controller (BMC), or an extensible firmware interface (EFI).

In one embodiment of the computer system, the first subset of electrodes is disposed above the second subset of electrodes to move the dust in a generally downward direction. An optional damper may be disposed below the dust filter, wherein the damper opens into communication with a duct through the computer chassis to the rear of the computer chassis. The duct should not contain any heat-generating components that could be damaged by the dust or by a lack of airflow when the damper is closed. A fan may be provided to draw air through the duct to the rear of the computer chassis when the damper is open. The same fan may also draw air through the main airflow pathway.

A further embodiment of the invention provides a computer program product including computer usable program code embodied on a computer usable medium for cleaning a dust filter. The computer program product comprises computer usable program code for applying a negative electrical potential to a first electrode disposed in a first area of a dust filter and applying a positive electrical potential to a second electrode disposed in a second area of the dust filter, wherein a voltage differential between the first electrode and the second electrode is sufficient to cause electrostatic movement of dust from the first area of the dust filter to the second area of the dust filter. The computer program product further comprises computer usable program code for applying a negative electrical potential to the second electrode and applying a positive electrical potential to a third electrode disposed in a third area of the dust filter, wherein a voltage differential between the second electrode and the third electrode is sufficient to cause electrostatic movement of dust from the second area of the dust filter to the third area of the dust filter, and wherein the first, second and third areas are generally linearly arranged with the second area between the first and third areas. It should be recognized that the computer program product may include computer usable program code to implement any one or more aspect of the methods described herein.

FIG. 1 is a perspective view of a computer chassis 10 that supports forced air cooling of heat-generating components, such a processor or memory modules (not shown), within the chassis. This chassis 10 is shown having a dust filter 14 in a first end of the chassis and a fan module 12 at a second end of the chassis. The airflow (illustrated by wavy arrows) enters the chassis through the dust filter, passes through the chassis to cool the heat-generating components, and is then exhausted out the back of the chassis. In some chassis, the fan module 12 may be omitted where there is either a multi-server chassis fan module or a computer room air conditioning (CRAC) blower that provides the air flow.

Figure 2:
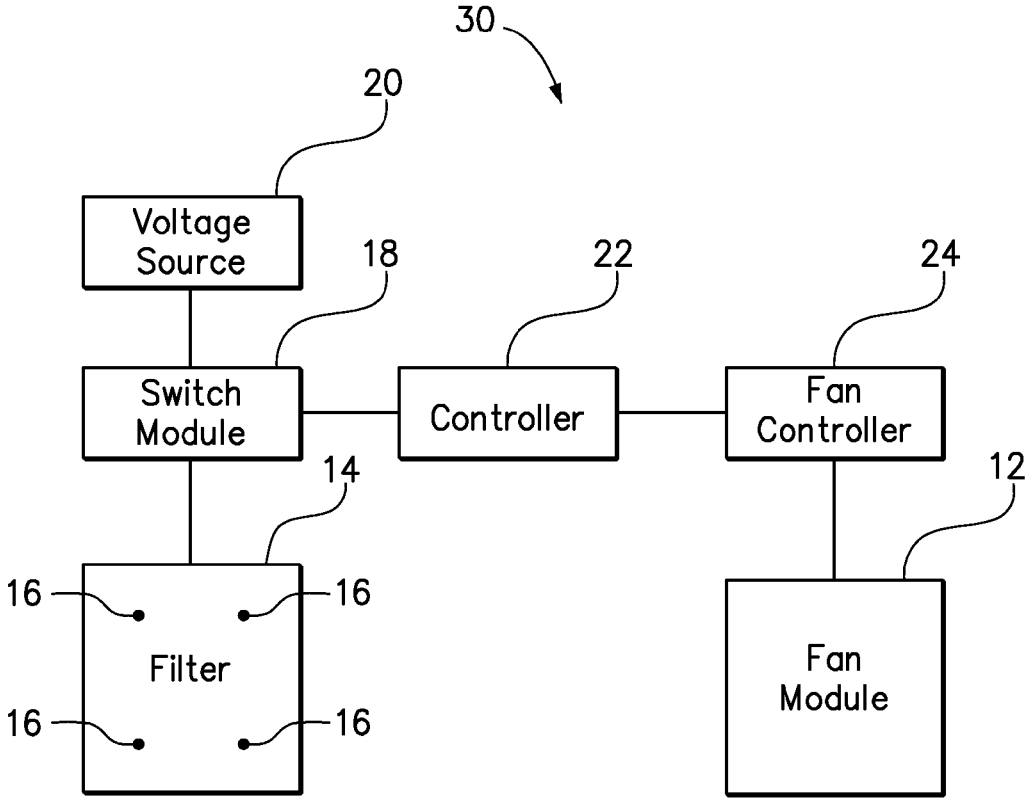
FIG. 2 is a block diagram of one embodiment of a system for cleaning a dust filter.

FIG. 2 is a block diagram of one embodiment of a system 30 for cleaning a dust filter. The system 20 includes the dust filter 14 and the fan module 12 of FIG. 1. However, the dust filter 14 is not shown having a total of four electrodes 16 that are used to clean the filter. These electrodes 16 are electrically connected to a switch 18 that can be used to selectively apply an electrical potential to one or more of the electrodes 16 from a voltage source 20. A controller 22 operates the switch 18 in order to apply the appropriate electrical potential to the appropriate electrode(s) 16 in order to sequentially move or "roll" the dust across the dust filter 14. Optionally, the controller 22 is also in communication with a fan controller 24 that controls and monitors operation of the fan module 12. The controller 12 can therefore instruct the fan controller 24 to reduce the speed of the fan module 12 when the electrodes 16 are being used to clean dust from the filter.

Figure 3:
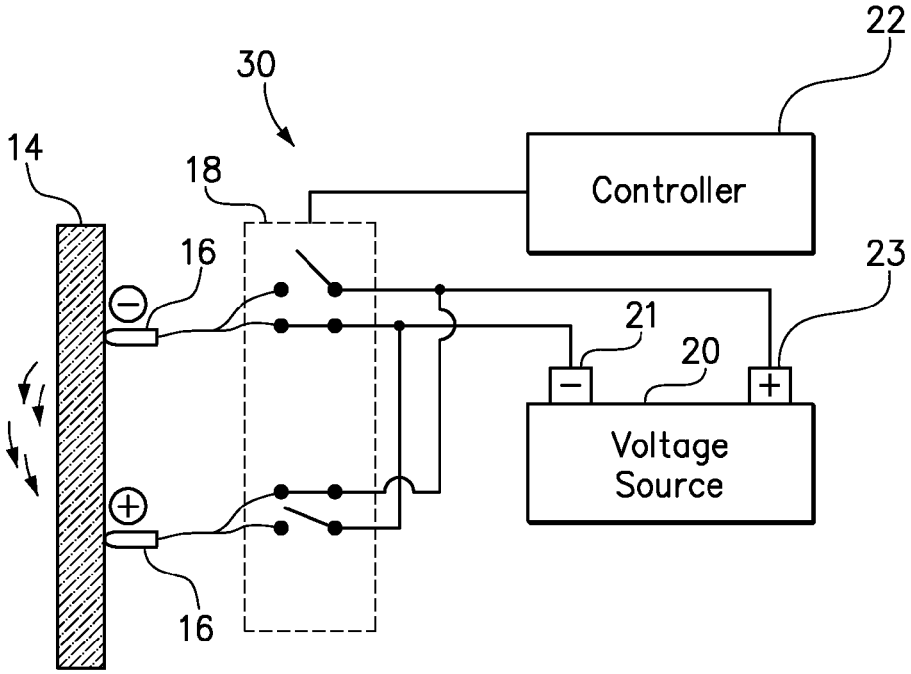
FIG. 3 is a schematic side view of an apparatus for cleaning a dust filter.

FIG. 3 is a schematic side view of a portion of the system 30 for cleaning the dust filter 14. First and second electrodes 16 are disposed directly adjacent the dust filter 14 on the downstream side with respect to an airflow direction. The controller 22 controls the operation of a switch module 18, which selectively couples the electrodes 16 with the negative terminal 21 of the voltage source 20 or the positive terminal 23 of the voltage source 20. As shown, the switch module 18 has completed the connection from the negative terminal 21 to the upper electrode 16 (shown having a negative charge) and the connection from the positive terminal 23 to the lower electrode 16 (shown having a positive charge). Accordingly, dust particles on the front face of the dust filter in the area around the upper electrode 16 become negatively charged and are attracted to the positively charged lower electrode. More complex electrode configurations may be implemented, but the basic control scheme is equally applicable.

Figure 4A:
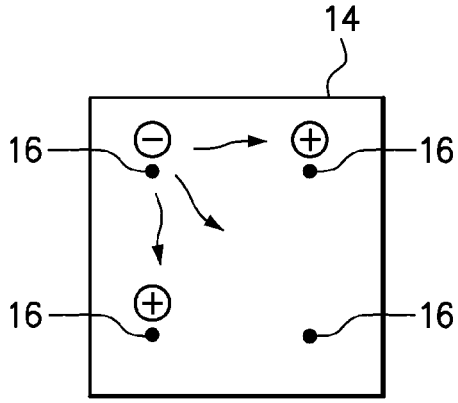
FIGS. 4A-4C are diagrams of one embodiment of a dust filter having a 2-by-2 array of electrodes for stepwise cleaning of the dust filter.
Figure 4B:
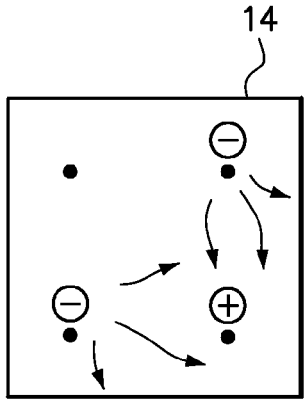
Figure 4C:
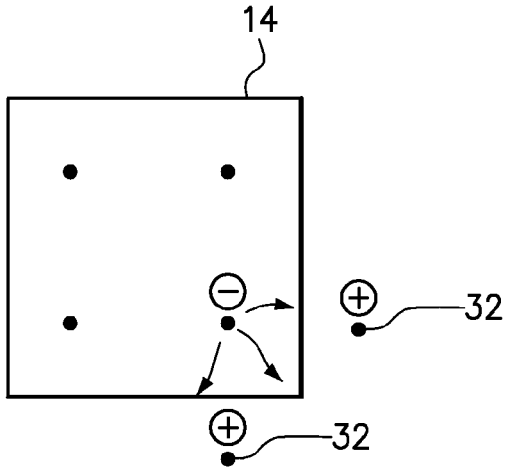

FIGS. 4A-4C are diagrams of one embodiment of a dust filter 14 having a 2-by-2 array of electrodes 16 for stepwise cleaning of the dust filter. First, in FIG. 4A, the upper left electrode is negatively charged, while at the same time the upper right electrode and the lower left electrode are positively charged. So long as the voltage differential between the negatively charged electrode and the positively charged electrodes is sufficient, dust will move from the negatively charged electrode toward the positively charged electrodes as illustrated by the arrows. The lower right electrode is not charged at all.

After some time period passes or a predetermined operating condition exists, the operation as in FIG. 4A is stopped, and the electrodes are charged as shown in FIG. 4B. In this step, upper left electrode is not charged, the upper right electrode and the lower left electrode are now both negatively charged, and the lower right electrode is positively charged. Accordingly, dust will move from the negatively charged electrodes toward the positively charged electrode as illustrated by the arrows.

After some additional time period passes or another predetermined operating condition exists, the operation as in FIG. 4B is stopped, and the electrodes are charged as shown in FIG. 4C. Here, two further electrodes 32 are positioned outside the area of the dust filter 14 to attract the dust particles away from the filter. For example, the electrodes 32 may be disposed in a duct for collecting or discharging the dust.

Figure 5A:
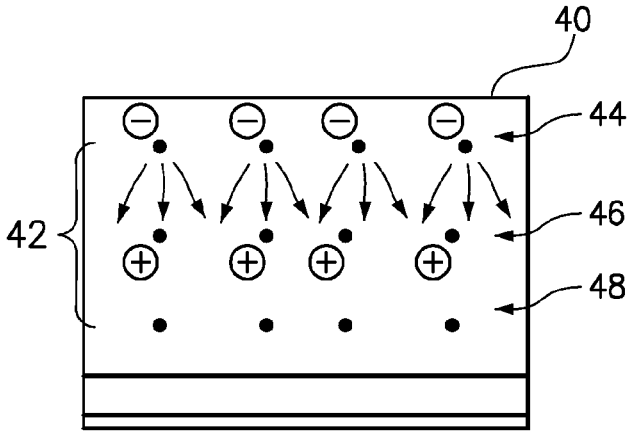
FIGS. 5A-5C are diagrams of another embodiment of a dust filter having a 3-by-4 array of electrodes for stepwise cleaning of the dust filter.
Figure 5B:
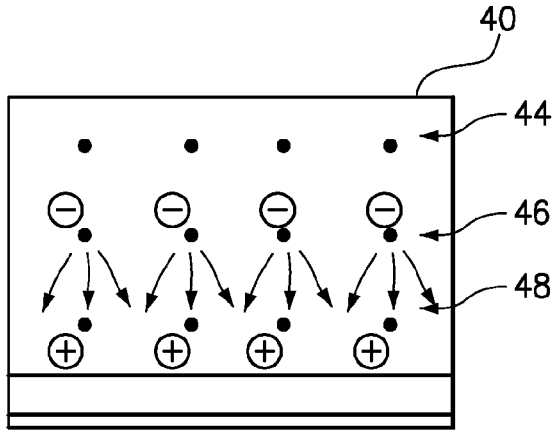
Figure 5C:
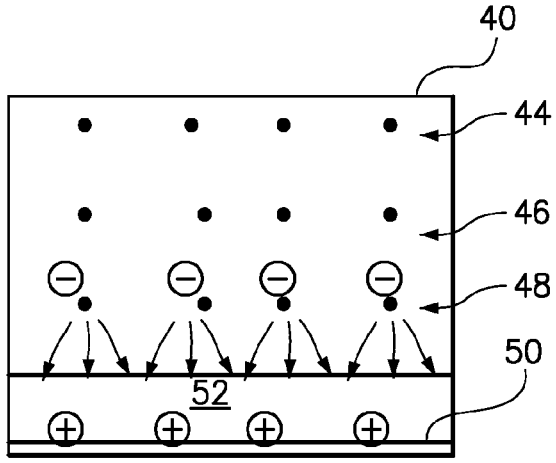

FIGS. 5A-5C are diagrams of another embodiment of a dust filter having a 3-by-4 electrode array 42 for stepwise cleaning of the dust filter 40. In this example, electrode array 42 is operated as three rows of electrode, where each of the electrodes in a given row is operated in the same manner. Accordingly, in FIG. 5A, the top row of electrodes 44 is negatively charged and the middle row of electrodes 46 is positively charged to move dust downward in the direction of the wavy arrows. Then, in FIG. 5B, the middle row of electrodes 46 is negatively charged and the bottom row of electrodes 48 is positively charged to move dust downward in the direction of the wavy arrows. After that, as in FIG. 5C, the bottom row of electrodes 48 is negatively charged and a plate electrode 50 is positively charged to move dust downward in the direction of the wavy arrows. As shown, the plate electrode 50 is on the far edge of a duct 52 that can carry the dust away.

Figure 6A:
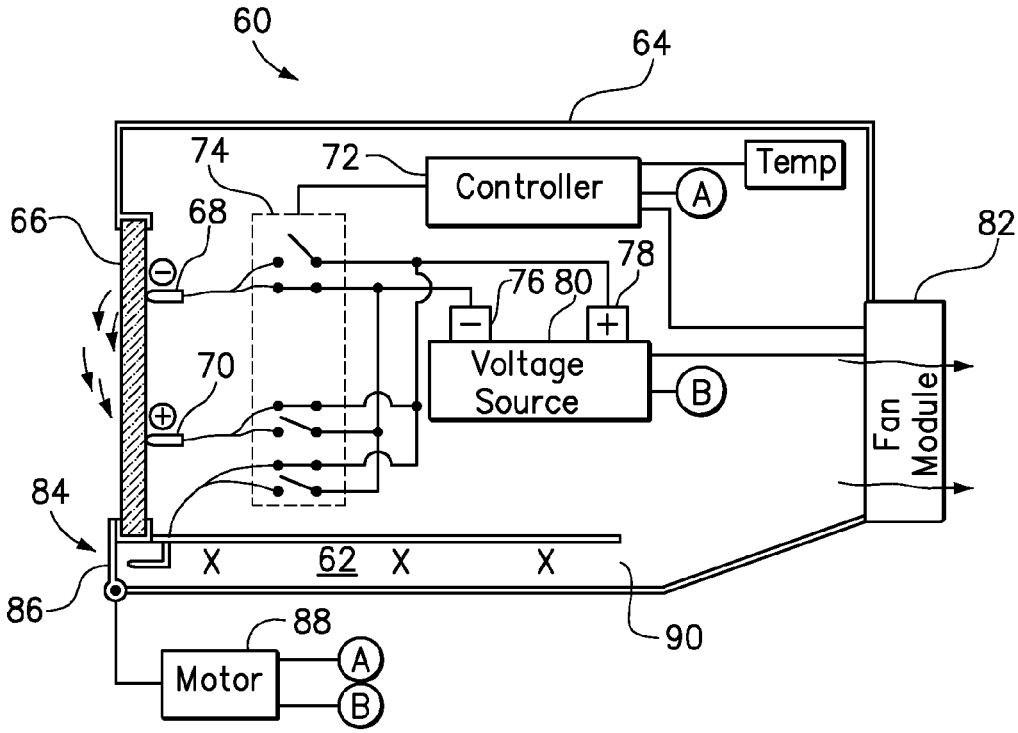
FIGS. 6A and 6B are schematic side views of a further embodiment of a system for cleaning a dust filter, where the system includes a duct for receiving the dust removed from the filter.
Figure 6B:
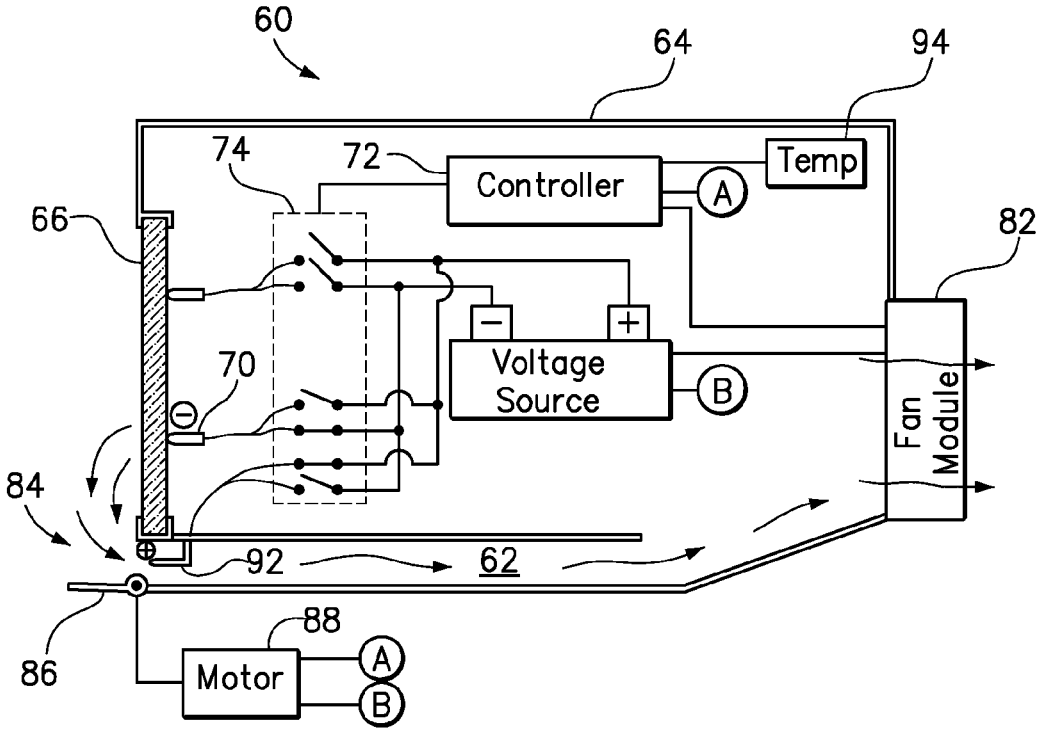

FIGS. 6A and 6B are schematic side views of a further embodiment of a system 60 for cleaning a dust filter 14, where the system includes a duct 62 in a chassis 64 for receiving dust removed from the dust filter 66. A first set of upper electrodes 68 and second set of lower electrodes 70 are disposed directly adjacent the dust filter 66 on the downstream side with respect to an airflow direction. The controller 72 controls the operation of a switch module 74, which is shown in FIG. 6A selectively coupling the set of upper electrodes 68 with the negative terminal 76 of the voltage source 80 and selectively coupling the set of lower electrodes 70 with the positive terminal 78 of the voltage source 80. Accordingly, dust particles on the front face of the dust filter 66 in the area around the set of upper electrodes 68 become negatively charged and are attracted to the positively charged set of lower electrodes 70. While the electrodes are being utilized to impart electrostatic movement of the dust, the controller 72 may instruct the fan module 82 to reduce its speed so that the dust has greater mobility on the dust filter.

The duct 62 has an inlet 84 that is covered by a damper 86. The damper 86 is closed in FIG. 6A, but is hinged to the chassis 64 and is coupled to a motor 88 that can open the damper 86. In order to clean the dust filter 66, the controller 72 may instructs the switch module 74 to activate the electrodes in a sequence that moves the dust across the surface of the dust filter 66. At the same time, the controller 72 may instruct the fan module 82 to reduce its speed. Still further, where the chassis 64 includes a duct 62, the controller 72 may instruct the motor 88 (via line A-A) to open the damper 86. Since the duct 62 has a distal end 90 that opens toward the fan module 82.

FIG. 6B shows the system 60 of FIG. 6A after the motor 88 has repositioned the damper 86 to an open position to allow air to flow through the duct 62. In a final stage of cleaning the dust filter 66, the set of lower electrodes 70 are provided with a negative charge and an electrode 92, disposed within the inlet 84 to the duct 62 is provided with a positive charge in order to attract the dust. The dust is then transported through the duct 62 under the force of the air flow and out the back of the chassis 64 via the fan module 82. When the filter 66 has been cleaned, the controller 72 will instruct the switch 74 to turn off the electrical potential to all of the electrodes and instruct the motor 88 to close the damper 86.

In one embodiment, a temperature sensor 94 within the chassis 64 is used to detect that there has been a rise in the temperature within the chassis 64. Such a temperature rise may be a result of a blocked dust filter, and a temperature that reaches a predetermined setpoint may be used as a condition for the controller 72 to initiate another dust filter cleaning sequence.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing. Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the invention.

The corresponding structures, materials, acts, and equivalents of all means or steps plus function elements in the claims below are intended to include any structure, material, or act for performing the function in combination with other claimed elements as specifically claimed. The description of the present invention has been presented for purposes of illustration and description, but it not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A computer system, comprising:

a computer chassis housing a processor and having an airflow pathway through the computer chassis;

a dust filter disposed in the airflow pathway;

a plurality of electrodes disposed across an area of the dust filter;

a voltage source having a negative terminal and a positive terminal; and a controller for selectively coupling a first subset of the plurality of electrodes to the negative terminal and selectively coupling a second subset of the plurality of electrodes to the positive terminal, wherein a voltage differential between the first subset of electrodes and the second subset of electrodes is sufficient to cause electrostatic movement of dust from an area of the dust filter near the first subset of electrodes to an area of the dust filter near the second subset of electrodes.

2. The computer system of claim 1, wherein the first subset of electrodes is disposed above the second subset of electrodes to move the dust in a generally downward direction.

3. The computer system of claim 2, further comprising:

a damper disposed below the dust filter, wherein the damper opens into communication with a duct through the computer chassis to the rear of the computer chassis.

4. The computer system of claim 3, wherein the duct does not contain heat-generating components.

5. The computer system of claim 4, further comprising:

a fan that draws air through the duct to the rear of the computer chassis when the damper is open.

6. The computer system of claim 3, further comprising:

a fan that draws air through the airflow pathway.

7. The computer system of claim 6, wherein the fan draws air through the duct wherein the damper is open.

* * * * *